US006145849A

United States Patent [19]

Bae et al.

[11] Patent Number: 6,145,849

[45] Date of Patent: Nov. 14, 2000

[54] DISK PROCESSING CHUCK

[75] Inventors: Peter S. Bae, Sunnyvale; Stanley M. Smith, San Jose; Kang Jia, Fremont; Warren C. Schroeder, Livermore; Michael E. Slafter, Fremont; Ronald Allen, San Jose, all of Calif.

[73] Assignee: Komag, Incorporated, San Jose, Calif.

[21] Appl. No.: 09/195,352

[22] Filed: Nov. 18, 1998

[51] Int. Cl.[7] ..... B23B 31/20; B23B 31/30; B24B 13/005

[52] U.S. Cl. ..... 279/4.07; 118/503; 279/4.03; 279/133; 279/156; 451/291; 451/385; 451/398

[58] Field of Search ..... 279/4.03, 4.07, 279/4.11, 133, 156, 4.05, 139; 451/285, 291, 292, 385, 390, 397, 398, 400, 402, 403; 118/503

[56] References Cited

U.S. PATENT DOCUMENTS

| | | | |
|---|---|---|---|
| 3,860,399 | 1/1975 | Noble et al. | 451/390 |
| 4,206,932 | 6/1980 | Felker | 279/4.05 |
| 4,669,226 | 6/1987 | Mandler | 451/390 |
| 4,817,556 | 4/1989 | Mears et al. | 118/503 |
| 5,429,376 | 7/1995 | Mueller et al. | 279/4.07 |
| 5,431,421 | 7/1995 | Thompson et al. | 279/139 |
| 5,542,685 | 8/1996 | Allen et al. | 279/2.02 |
| 5,582,534 | 12/1996 | Shendon et al. | 451/291 |
| 5,651,724 | 7/1997 | Kimura et al. | 451/285 |
| 5,785,324 | 7/1998 | Williams et al. | 118/503 |
| 5,899,800 | 5/1999 | Shenson | 451/291 |
| 5,964,653 | 10/1999 | Perlov et al. | 451/285 |

FOREIGN PATENT DOCUMENTS

| | | | |
|---|---|---|---|
| 4-250963 | 9/1992 | Japan | 451/390 |

*Primary Examiner*—Steven C. Bishop
*Attorney, Agent, or Firm*—Skjvern, Morrill, MacPherson, Franklin & Friel, LLP; David E. Steuber

[57] ABSTRACT

A memory disk having a central opening and planar sides for receiving magnetic media on both of the sides is bounded by a cylindrical outside diameter peripheral edge and chamfered edges extending between each of the planar sides. The peripheral edge is clamped by a disk processing chuck including a disk retainer mount having a central disk support for mounting a circular disk edge bounding the central opening and a mount cylindrical beveled edge receiving an outside diameter chamfered edge of the disk. A ring in the retainer mount includes a multiplicity of spaced radial fingers extending cylindrically around the ring, each finger having a distal end extending to a first position outboard of the disk peripheral edge. The distal ends are moveable inwardly to a second position by an inflatable bladder acting simultaneously against all the fingers, placing the distal end tips into clamping contact with the disk peripheral edge mounted on the retainer mount.

18 Claims, 8 Drawing Sheets

DISK PROCESSING CHUCK

FIELD OF THE INVENTION

The invention relates to a chuck for holding a disk to be subjected to processing such as a polishing step. More particularly the invention is directed to a disk chuck which permits polishing, of a read/write memory disk or a compact disk or CD ROM disk held by the chuck, to a super smooth finish while minimizing or preventing deformation of the disk or destructive marking of the disk due to handling or processing.

BACKGROUND OF THE INVENTION

U.S. Pat. 5,542,685 having some inventors common with the above inventors and commonly assigned, includes a discussion of the technology of disks used in computer memory storage devices. Particularly, such patent discloses the problems attendant to the processing of the disks resulting in disk deformation and other damage caused by the handling and by the processing method and process apparatus. In that patent, a clamp or chuck is disclosed where a pair of clamping portions contact respective chamfered edges on a central disk aperture such that the disk is clamped by forces essentially acting traversely to a plane of the clamped disk. One of the clamping portions included a collet with collet segments being expandable to create a force against the chamfered edges at the disk ID. While this patent has been used commercially, the latest technology has required disks with improved smoothness and without substantially any deformation.

It has also been suggested by others that disk processing operations include processing and polishing the disk on both of its planar sides at the same time to save processing time and expense. However, it has been found that it is basically impossible to obtain a super smooth surface while polishing on both sides at the same time because as long as a polishing pad is in contact with a polished disk surface one will still see some marks, whether it is a polishing-induced mark, or a handling mark or a mark caused by the normal robot unloading of the disk from a carrier. Further, there normally are variations in the top and bottom polishing pads used so that the pad used for polishing one side of the disk is different from the pad used for polishing the opposite side of the disk. Also, since one disk side faces upwardly, contaminating particles can fall by gravity on the disk surface causing imperfections on that disk side. Also in the SpeedFam Inc. polisher devices currently employed by the disk manufacturing industry, the disks are mounted on a carrier thus being subject to scratches and deformation by contact with the carrier.

In general, equipment and processes as currently used, result in polished disk surfaces of about seven angstroms (7 Å) in surface roughness. The term "super smooth" as used herein describes a desired surface roughness of less than three angstroms RMS. Particularly a surface roughness of only 2 Å or 1 Å is desired along with no significant change in disk flatness, i.e., no deformation of the disk. In the prior '685 patent directed to a device holding a disk at its internal diameter (ID), it was found that the pressure on the ID by the collet segments necessary to hold the disk, was such as to cause some disk deformation. This was particularly apparent in polishing aluminum disks and when the disks are vacuum-held in a carrier cavity on a polishing table of a disk polishing machine such as a SpeedFam polisher.

Others have approached the matter of disk smoothness by sequentially polishing the disk in a number of polishing machines using polishing slurries having finer and finer polishing particulates. The lost transfer time and the multiple sequential steps all increase the processing costs and limit yield. These costs are in addition to the capital costs of buying, operating and maintaining a multiplicity of polishing machines.

SUMMARY OF THE INVENTION

The present invention is directed to a disk processing chuck in which a series of movable centipede-like fingers contact and clamp against a peripheral edge of a disk. The disk peripheral edge forms the outside diameter (OD) of the disk and is normally bounded by chamfered edges leading to respective planar sides (surfaces) of the disk which are to be burnished and polished to a desired surface smoothness. Subsequently the disks, for example, aluminum disks, are coated with a magnetic media such as 20% Co, 70% Ni and 10% Pt by sputtering the media essentially over all of the planar surfaces on both sides of the disk between the above-mentioned chamfered edges and other chamfered edges bounding a central aperture in the disk. These central chamfers also are used to facilitate the mounting and centering of the disk on a disk drive spindle. These central chamfers also minimize stress concentrations at the central aperture edges and prevent build-up of coating material at the ID of the disk.

The processing chuck of the invention includes a central disk retainer mount having a relaxation (non-clamping) support for mounting a central portion of the disk, more particularly mounting one of the chamfered edges bounding the disk central opening. The central chamfered edge of the disk rests on the retainer mount. A chamfer edge at the OD of the disk is mounted (rests on) a beveled edge of the retainer mount. The disk chamfer edges at the center and at the periphery typically are at a 45° angle but other angles such as 40° or 50° may be employed. A retaining ring is seated in the retainer mount peripherally outward of the beveled edge mounting the disk. The ring includes a multiplicity of spaced radial fingers extending cylindrically around the ring. Each finger has a distal end extending to a first position outboard of the OD peripheral edge of a disk to be mounted to the chuck. The distal ends are movable inwardly to a second position into clamping contact with the disk OD peripheral edge mounted on the retainer mount. The clamping force F resultant from movement of each distal end is relatively small, of the order of about 1.5 kg (3 pounds). The forces F, are directed radially inwardly in compression against the disk peripheral edge and are substantially perpendicular to the disk peripheral edge. The magnitude of the total radial force $F_T$ exerted on the disk is $F_1$ times n where n is the number of fingers. In a preferred embodiment seventy-two radial fingers are provided. This number was chosen so that no part of the disc periphery is subject to more than a 1.5 kg force and thus minimizes any deformation, cracking or other damage to the disk from the clamping action.

Movement of the fingers in a radial inward direction is provided in the preferred embodiment by the cylindrical expandable air bladder in the form of a torus surrounding an intermediate portion of an outside periphery of the fingers. Inflation of the bladder collectively moves the distal ends of each finger inwardly to forcedly contact the OD peripheral edge of a mounted disk and clamp the disc against rotation relative to the retainer mount. The fingers preferably are made of resilient stainless steel or beryllium-copper so that they may be flexed (bowed) inwardly to place the distal ends of the fingers simultaneously into a clamping arrangement with the disc peripheral edge. Each of the fingers have proximal end forming the retaining ring which is attached to the retainer mount. Upon deflation of the bladder the strained fingers, no longer being subject to compressive stress by the bladder, return to their original unbowed shape due to their resiliency, thus unclamping the disk. During the deflation of the bladder the disk is held on the mount by a robot effector acting against the outwardly-facing central chamfered surface of the disk and the central aperture.

Upon deflation and unclamping of the disk by spring movement of the fingers back to the first position, the robot effector can remove a disk from the chuck and then reverse, i.e. turn upside down, a polished-on-one side disk 180° so that the disk with its one polished surface is remounted in the mount and the unpolished surface faces outwardly for subsequent reclamping of the disk in the mount for processing of the opposite planar surface of the disk. Alternatively, if both planar surfaces have been polished, the fully-polished disk can then be robotically removed from the chuck and conveyed, for example, to a cassette for storage or directly to a magnetic media sputtering station.

In a preferred embodiment, the distal ends of the fingers have a thickness approximate the width of the disk peripheral edge so that a planar side of the disk extends unimpeded outboard of the fingers in a position to be polished. That planar side (surface) is then placed into polishing pressure contact with a rotating polishing pad. The mount and the disk held in the chuck normally also are rotated in the same circumferential direction as the polishing pad during the polishing operation.

To compensate for any misalignment of the polishing pads on the polishing machine and the disk clamped in the processing chuck, the retainer mount may be gimbaled to a fixed base of the chuck by a semi-spherical bulbous distal portion mounted in a semi-spherical-bottomed bore in the retainer mount. A dampener in the form of a flexible metal ring extends between the fixed base and a periphery of an air bladder support ring extending around the retainer mount for damping the gimbal action and to connect the base and a disk retainer mount. The retainer mount also contains on the surface, including the beveled edge, an open toroidal cavity having a radial width at least corresponding to the width of the planar surfaces of the to-be-mounted disk so that a polished planar surface of the disk does not physically contact the retainer mount when the other opposite planar surface is exposed for polishing.

The use of the chuck of the present invention can be used for circumferential polishing trajectories to eliminate random polish scratches/patterns, to increase areal density, improve yield and improve magnetic performance by lessening the error rate. The super-polish of the disks provides extremely low roughness, improves glide avalanche and essentially eliminates random scratches. These attributes are attained while providing for relatively high material removal rate of the order of more than 20 micro-inches per minute with a process time of about 30 seconds per disk planar surface. The disk chuck is reliable, is non-planar surface contacting, provides a stable, vibration-free system, has clean room compatibility and has a low cost. The chuck provides high and low sliding speeds. Sliding speed as used herein means a radial or oscillation movement of the chuck and its attached disk, as distinguished from the rotation of the chuck and the attached disk relative to the polishing table.

DETAILED DESCRIPTION

Figure 1:
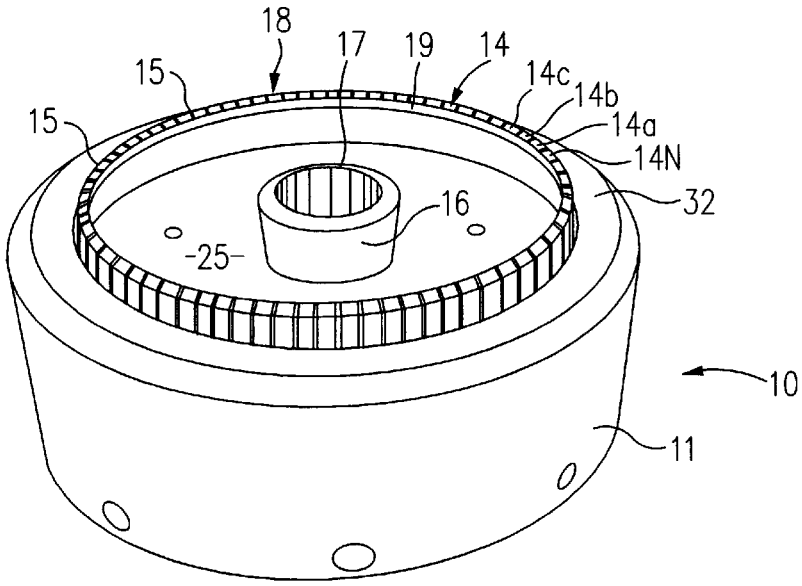
FIG. 1 is a front perspective view of the disk processing chuck.
Figure 2:
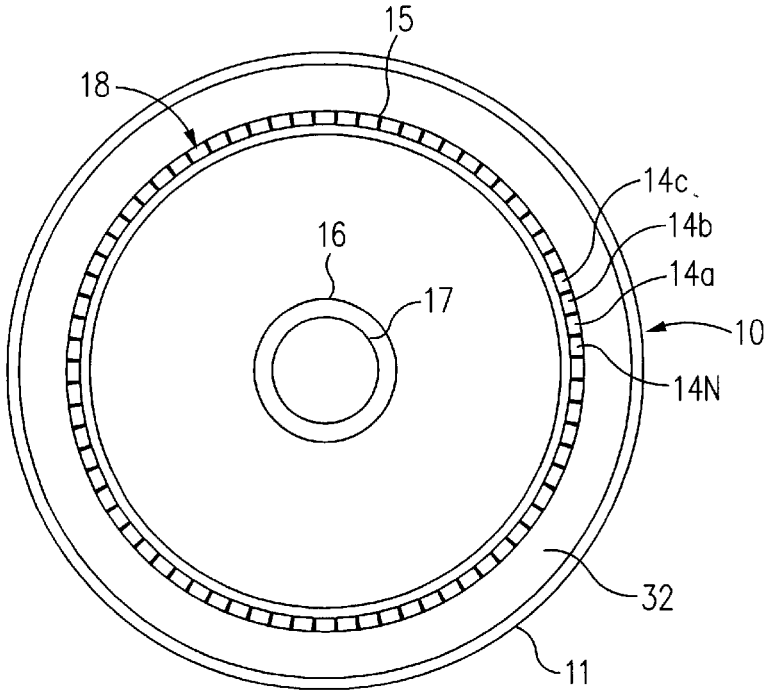
FIG. 2 is a perspective view of a modification of the chuck.

FIGS. 1 and 2 illustrate a first embodiment of the invention where the disk processing chuck 10 is poised to receive a memory or other disk. The chuck is designed to operate using a memory disk of conventional construction such as an aluminum disk or other metal, plastic, glass or ceramic disk whose diameter and thickness have become progressively smaller and thinner as disk technology has advanced, typically going from 130 mm to 95 mm to 65 mm to 48 mm and less in diameter and having thicknesses of 1.98 mm for a 130 mm disk to 0.38 mm for a 48 mm disk (or thinner). The disk 50 has a central opening 39 (FIG. 6) bounded by interior and exterior chamfered surfaces or edges 52 extending from the opening 39 to annular planar surfaces 53, 54 (FIG. 8) of the disk which are to be polished and eventually coated with magnetic material. The disk 50 includes an outer diameter peripheral edge 51 perpendicular to the planar surfaces and separated therefrom by chamfered edges 52 extending from the peripheral edge to the planar surfaces.

Figure 3:
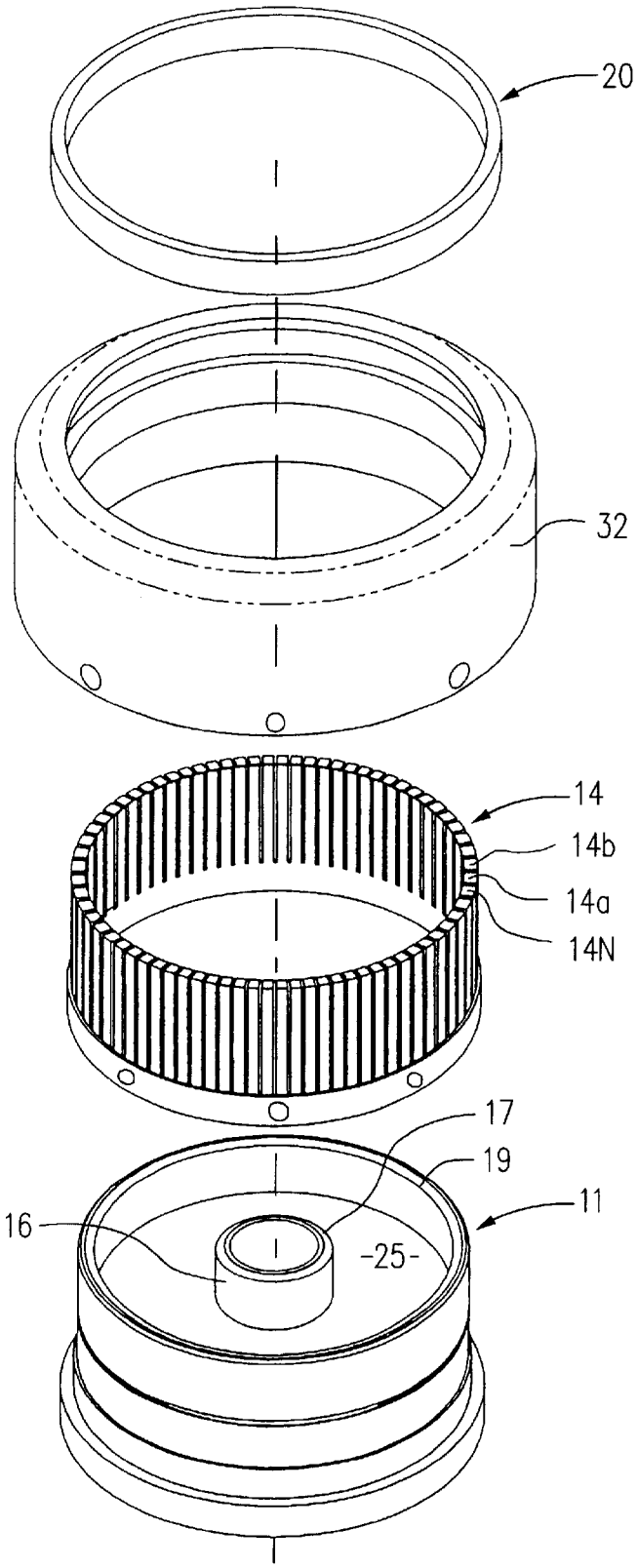
FIG. 3 is an exploded view of the chuck of FIG. 1.
Figure 7:
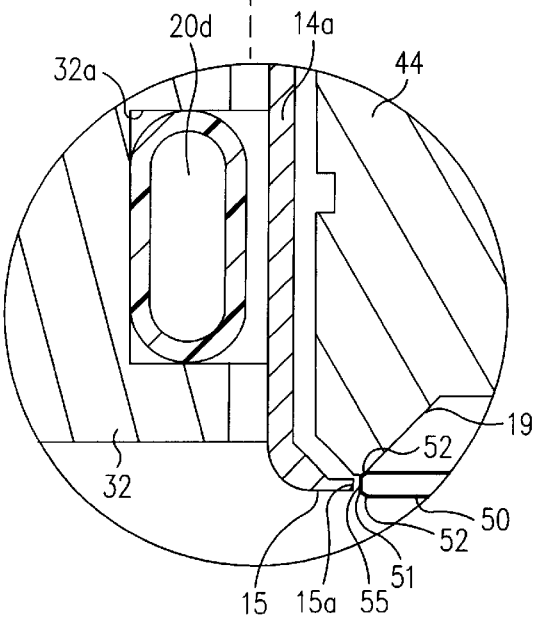
FIG. 7 is an enlarged cross-sectional view of the circled portion A of FIG. 6 showing the air bladder in a non-inflated condition and a resilient finger in the non-clamping position.

The disk processing chuck 10 includes a disk retainer mount 18 having a fixed base 11 and an integral upstanding, cylindrical central disk support 16 having a top beveled or chamfered edge 17 for receiving a disk interior chamfered surface 52 next to the disk central opening 39. The disk rests on disk support 16 in a relaxation mode i.e. without being clamped thereon. The retainer mount 18 also contains a top inclined beveled surface 19 which receives an interior-facing chamfered surface 52 of the disk. Fixed to a lower extremity of base 11 by screws 21 is a ring 14 having a multiplicity (typically 72 in number) of spaced radial fingers 14*a*, 14*b*, 14*c*–14N, N representing the seventy second finger. The fingers are normally formed by splitting the top edge of ring 14. Each finger has an inwardly directed distal end 15 having a radiused tip 15*a* (FIG. 7). Typically, the radius conforms to the curvature of the disk outside diameter peripheral edge 51. An air bladder support ring 32 surrounds the array of fingers 14. An annular cavity 25 is formed in base 11 which cavity has a radial width at least as wide as the planar surfaces of the disk to be mounted in the disk mount. The cavity provides a free-space so that a polished surface, of a disk rotated 180° to be polished on the opposite planar surface, does not contact any part of the disk processing chuck. The bladder support ring 32 including a toroidal cavity 32*a* (FIG. 7) encloses a toroidal air bladder 20 (FIGS. 3 and 4) which functions when inflated to move the fingers 14 inwardly so that distal ends 15, more particular the radiused tips 15*a*, are forced against the peripheral edge 51 of the disk 50 (FIG. 8) so as to firmly clamp the disk at seventy-two spaced areas (for example) on the peripheral edge 51.

Figure 4:
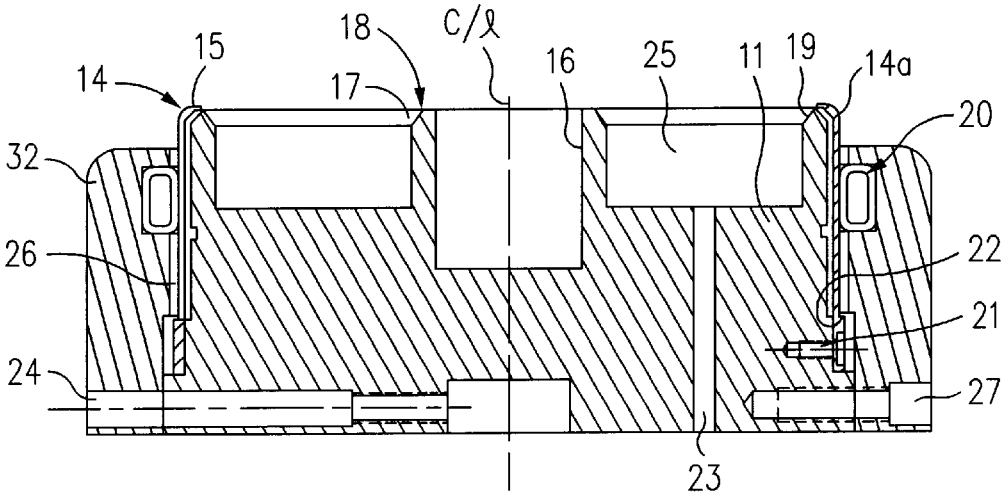
FIG. 4 is a cross-sectional view of an embodiment of the disk processing chuck.

FIG. 4 shows the integration of the disk mount 18, the ring 14, the fingers 14*a* etc., the toroidal bladder 20 and the bladder support ring 32. The fingers 14*a*–14*n* extend integrally from ring 14 and ring 14 is attached by bolts or rivets 21 to base 11. Base 11 and ring 32 are typically made of aluminum or stainless steel. The ring 14 and fingers 14*a* etc. preferably are heat tempered to RC hardness of about 50 to 55 and are constructed from a resilient 440-C stainless steel the fingers, in a chuck for a 95 mm disk, have a length of about 25 mm, a width of about 2 mm and a thickness of about 0.5 mm. The bladder center is spaced intermediate of the distal and proximal ends of the fingers so that inflation of the bladder to about 10 psi results in a force against each finger equally and moves the distal ends 15 of the fingers, more particularly the tips 15*a*, into contact with the disk peripheral edge 51. Provided in the base 11 is a vent 23 for vent to relieve any vacuum in bore 25, and an inlet 24 for conveying pressurized air to the bladder (See FIG. 5) through flexible tubing 47 in a bore 26 in ring 32. The bladder is made of a rubber material having a thickness of about 1 mm and has a durometer reading of about 40 to 50.

Figure 5:
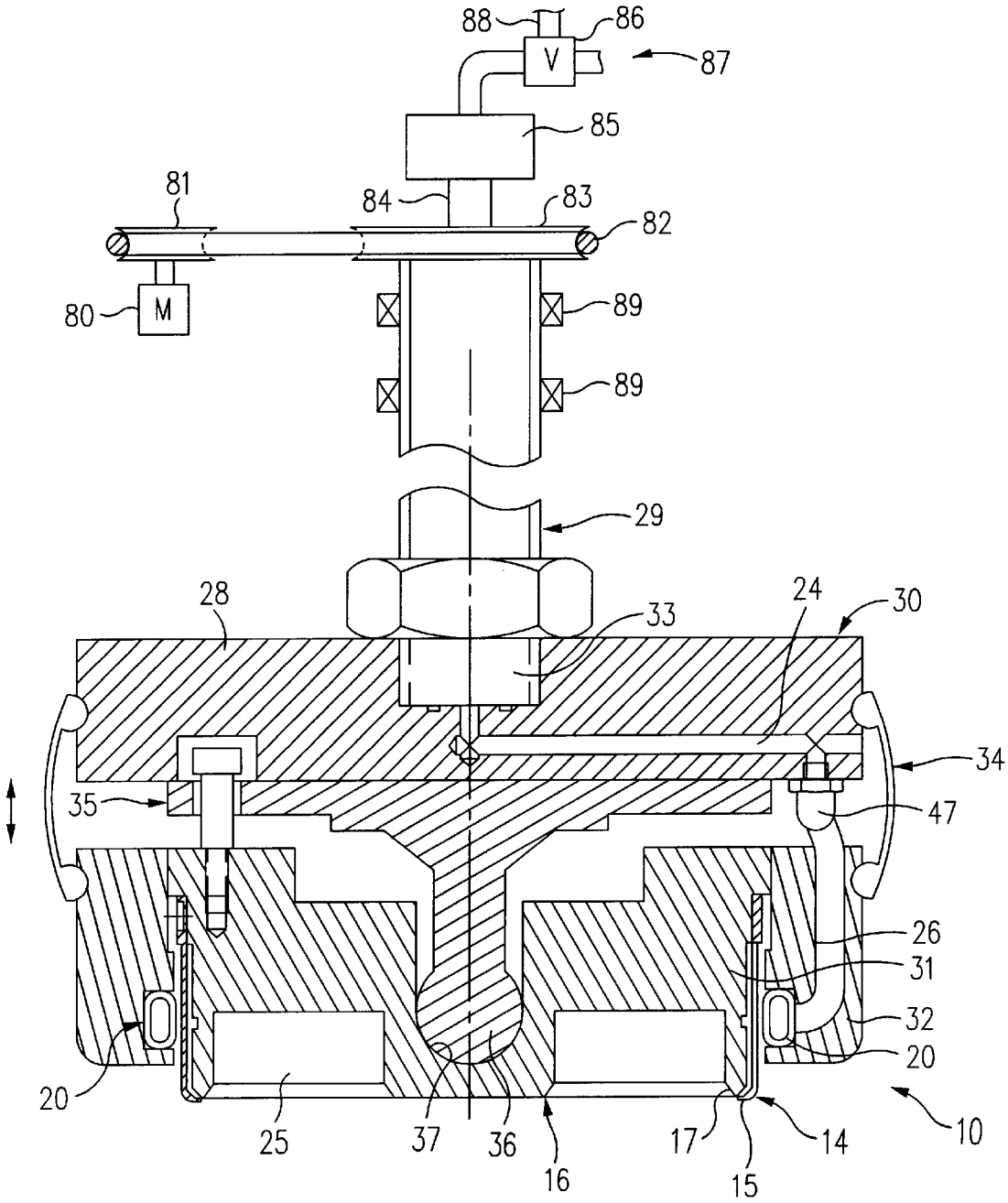
FIG. 5 is a cross-sectional view of a first gimbaled embodiment of the chuck including a chuck rotary drive.

FIG. 5 illustrates a gimbaled chuck 30 of the invention where a fixed base 28 includes an extension 35 affixed thereto by screws (not shown). The extension includes a substantially ¾ hemispherical bulbous end 36 which is universally movable over a few degrees of arc, namely from about 5° to about 10°, with respect to a modified disk mount 31. The disk mount includes a hemispherical-bottomed bore 37 in which the bulbous end 36 is rotatable and tiltable in all directions. FIG. 5 also shows a rotary drive and air pressure pipe connection 29, 33, and bore 26 in retainer ring 32 through which a tube 47 extends, for conveying pressurized air to the bladder 20. A motor 80 drives a pulley 81 which, through a drive belt 82, rotates a pulley 83 fixed to a pipe 29 which is rotatable with the overall chuck 30. Bearings 89 support pipe. An air supply tube 84 connected to a rotary coupling 85 extends through pipe 29 to inlet 24. Pipe 84 is connected to a three-way valve 86 allowing for flow of pressurized air from a source (arrow 87) or for non-flow on the venting by vent 88 and thus deflating bladder 20. Such deflation allows the resilient fingers 14*a*–14*n* to return to their original unstress condition releasing the force holding the then polished disk. The dampener ring 34 holds the base 28 and the disk mount 31 and is sufficiently flexible as shown by the doubled-headed arrow to compensate for the gimballing movement.

Figure 6:
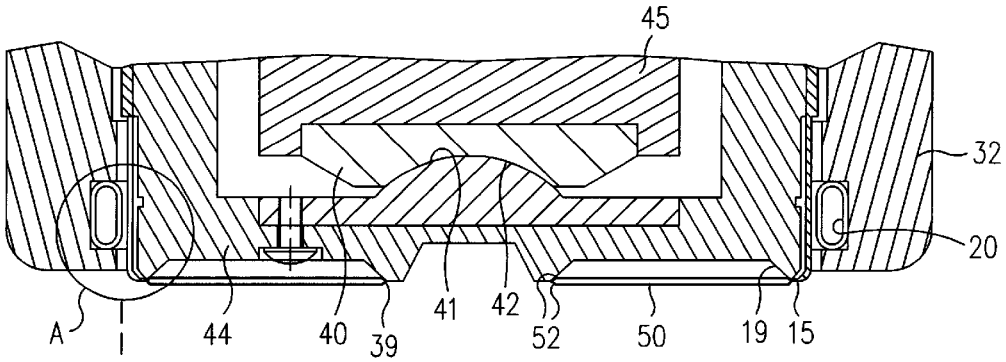
FIG. 6 is a cross-sectional view of a second gimbaled embodiment of the chuck.

FIG. 6 shows a second embodiment of a gimbaled chuck where a fixed base 45 includes an extension 40 having a partial hemispherical surface 41 screw-affixed thereto. A modified disk mount 44 has a matching hemispherical surface 42 allowing for rotation and tilting of the disk mount 44 relative to the base 45. The gimbal permits the overall chuck to conform to any variation in a polishing pad planarity with respect to the disk planarity when the disk planar surface and the polishing pad surface are brought into pressure polishing contact.

Figure 8:
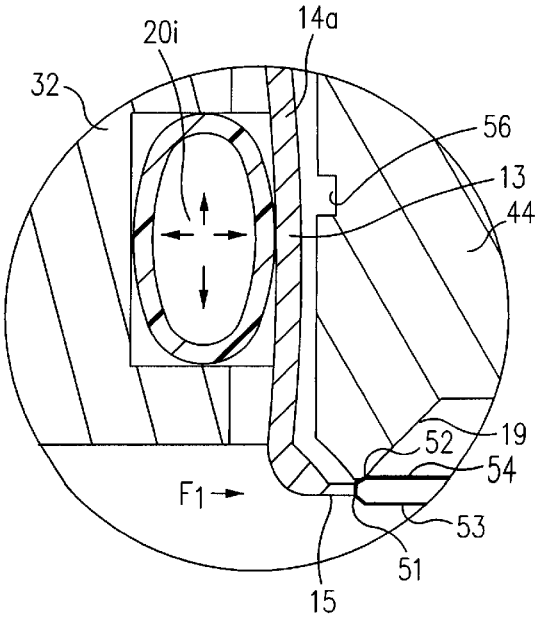
FIG. 8 is an enlarged cross-sectional view of the circled portion A of FIG. 6 showing the air bladder in an inflated condition and the resilient finger in a bowed disk-clamping position.

FIG. 7, as discussed above, show the deflated condition 20*d* of the bladder 20 with the radius tip 15*a* of the distal end 15 of a finger, gap-spaced from the disk outer diameter peripheral edge 51. This gap 55 is of the order of about 0.2 mm. FIG. 8 shows the inflated condition 20*i* of the bladder 20 with the expanded bladder shown by arrows forcing a finger 14*a* into a bowed condition at an intermediate portion 13 and tip 15*a* forced by force F, against the disk peripheral edge 51 to effect the clamping action holding the disk in the chuck.

Figure 9:
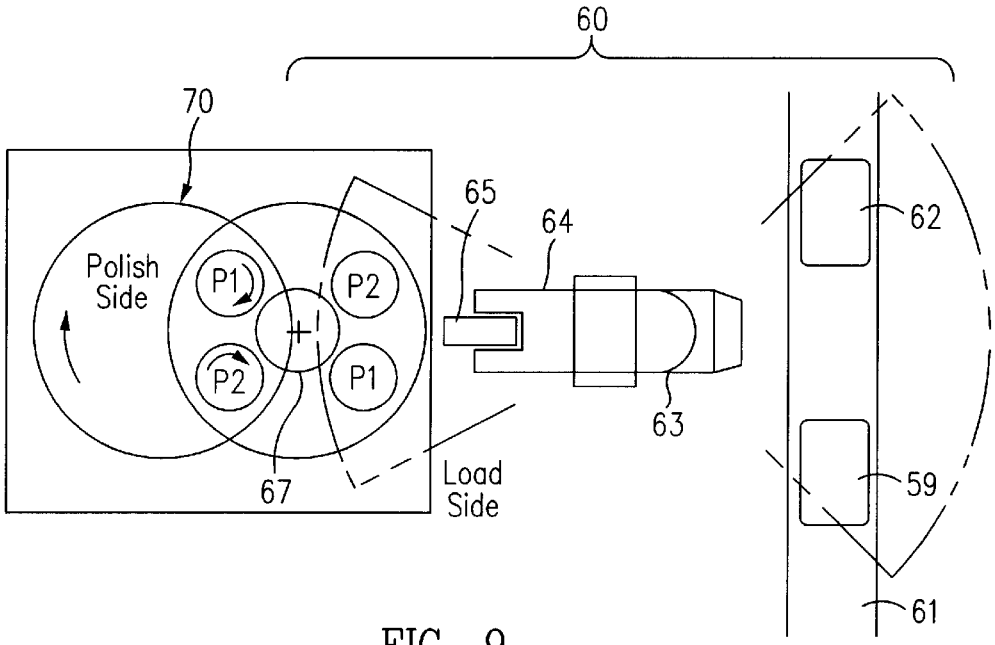
FIG. 9 is a schematic top view showing a sequence of operations of unloading, uploading, flipping, installing and polishing a disk mountable in the disk processing chuck of the invention.
Figure 10:
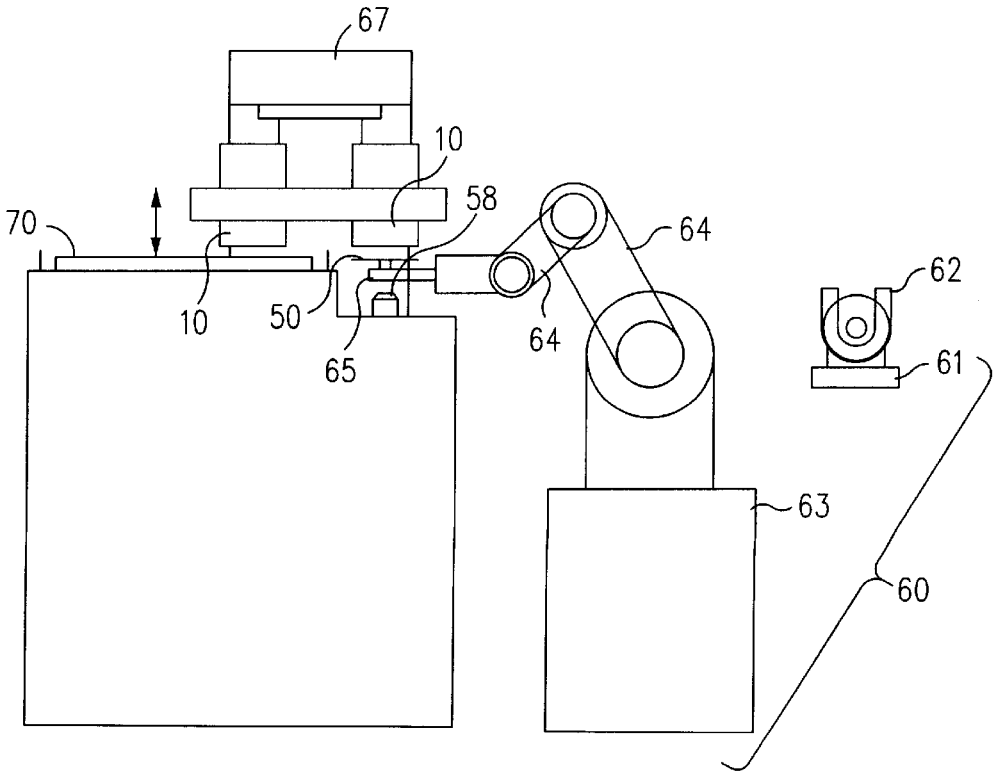
FIG. 10 is a schematic side view thereof.

FIGS. 9 and 10 illustrate the sequence of operations by a polishing and robotic apparatus 60 including a rotating multi-station polisher 70, showing both the unloading and polishing of disks clamped by a pair of disk processing chucks 10. While two disks are being rotated and polished at positions P1 and P2 a fully polished disk is unloaded from position P2 and placed in an outgoing cassette 62 on conveyor 61. In the next sequence during the continuing polishing of the two discs, a single side polished disk from position P1 is unloaded, flipped over by a robot effector 65 and placed on a disk loader 58. The disk may be rinsed on this disk loader. A new unpolished disk 50 from cassette 59 is robotically loaded at position P2. The disk which was flipped at P1 onto the loader is then reinserted into the chuck 10, to be coincidental to the P2 load of an unpolished disk. The disk spindle assembly 67 is rotated 180° so that the then polished disks move to the pick-up position and new unpolished disks are placed in a position above the polishing pad. The spindle assembly including the chuck-held disks are moved downwardly into contact with the polishing pad and the disks are polished. During polishing the above steps are repeated on disks just polished. The effector 65 is connected by pivot arms 64 connected to an overall robot 63, such as a Model R90 robotic system available from Staübli Co. of Germany.

Figure 11:
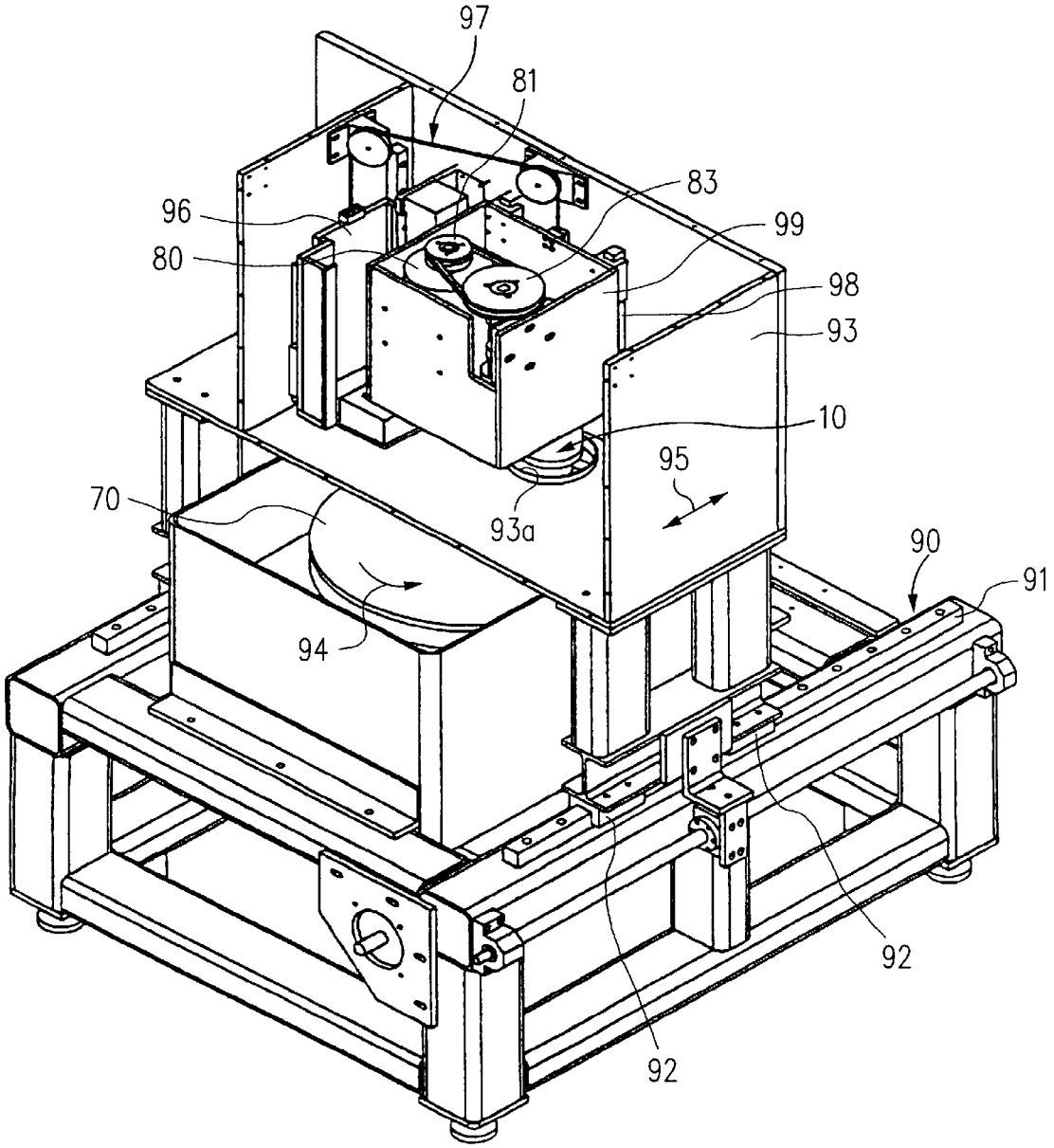
FIG. 11 is a perspective view of a prototype of the invention showing the rotation and oscillation of the chuck in a frame.

The chuck of the invention additional to the rotary motion illustrated in FIG. 5, may be oscillated radially with respect to the polishing pad of the polisher 70 by providing an oscillation slide 90 as illustrated in FIG. 11. The slide 90 includes a linear rail 91 and followers 92 on opposite sides of a frame 93 supporting the chuck 10 extending through an aperture 93*a* in the frame. The chuck is rotated by a belt-driven pulley 83. This oscillation is radial with respect to the rotating polisher table 70 as seen by arrows 95 and 94, respectively.

FIG. 11 also shows a weight 96 and pulley and wire assembly 97 for providing a vertical pressure force of the disk being polished on the polishing pad of the polishing table 70. The chuck is movable vertically by a vertical lead screw or by a hydraulic cylinder (not shown) to move the chuck downward into contact with the polishing pad during the actual polishing operation with the polishing force being supplied by a selected weight 96. The force is transmitted through a cage 99 vertically slidable by vertical rails 98.

Figure 12:
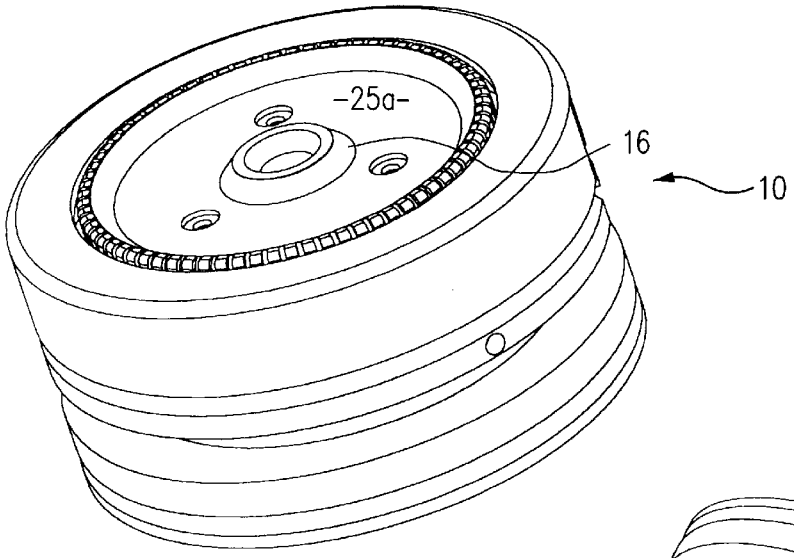
FIG. 12 is a perspective view of a modified embodiment of the chuck
Figure 13:
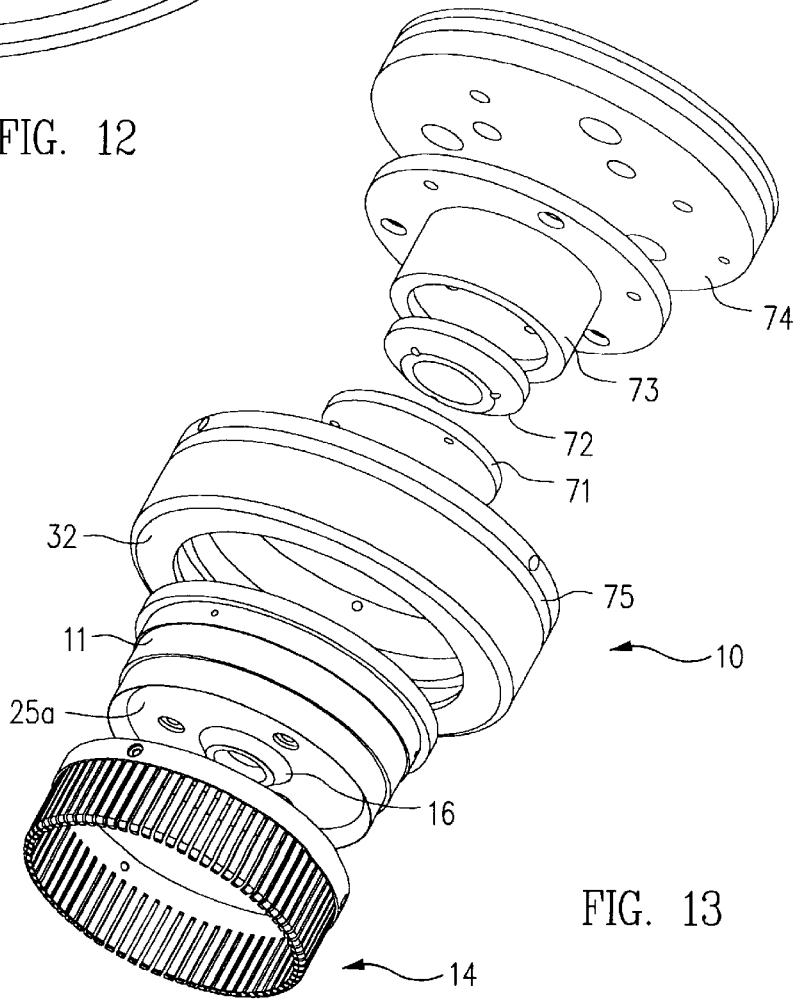
FIG. 13 is an exploded view thereof.

FIGS. 12 and 13 illustrate a modified chuck where the central disc support 16 is conical and extends to surface 25*a*. A gimbal bottom 71 locates with a gimbal top 72 to allow disk clamp 14 of chuck 10 to rotate to compensate for any misalignment. A top gimbal mount 73 mounts the gimbal top 72 and attaches to top plate 74. The top plate is a mounting plate for the chuck and its rotating spindle. The cut out area 25*a* prevents the data surface of the disk from coming into contact with the mount. The bottom gimbal mount 11 provides a mount for gimbal bottom 71 for locating the inner and outer diameters for holding the disk, locating for loading and unloading disks, and locating the bladder holder and the disk clamp 14. The bladder holder 32 includes a recess (not shown) to hold a protective boot 75 to keep contaminants out of the chuck. The top plate 74 also may include a recess to hold the protective boot to keep contaminants out of the chuck.

The above description of embodiments of this invention is intended to be illustrative and not limiting. Other embodiments of this invention will be obvious to those skilled in the art in view of the above disclosure.

What is claimed is:

1. A disk processing chuck for holding a memory disk, the disk having a central opening and planar sides for receiving magnetic media on both of the sides, the disk being bounded by a cylindrical outside diameter peripheral edge and chamfered edges extending between each of the planar sides and the peripheral edge, said chuck comprising:

a disk retainer mount including a central disk support for mounting a circular chamfered edge of the disk bounding the disk central opening and a peripheral mount edge for receiving one of the outside diameter chamfered edges of the disk;

a retaining ring seated in said retainer mount, said ring including a multiplicity of spaced radial fingers extending cylindrically around said ring, each finger having a distal end extending to a first position outboard of said mount edge; and wherein the distal ends are movable inwardly to a second position into clamping contact with the outside diameter peripheral edge of a disk mounted on said retainer mount.

2. The disk processing chuck of claim 1 further including a cylindrical expandable air bladder surrounding an intermediate portion of an outside periphery of said fingers for collectively moving said distal ends inwardly to forcedly contact the outside diameter peripheral edge of the mounted disk and clamp the disk against rotation relative to said retainer mount.

3. The disk processing chuck of claim 2 wherein said fingers are flexible and are deformable by a force provided by inflation of said bladder.

4. The disk processing chuck of claim 2 wherein said distal ends of said fingers have a thickness approximate that of a width of the outside diameter peripheral edge of the disk being clamped such that one of the planar sides of the disk extends unimpeded outboard of the fingers.

5. The disk processing chuck of claim 4, in combination with a polishing machine, wherein at least one of the retainer mount and a polishing pad is movable orthogonally relative to each other to bring that one of the planar sides of the disk into polishing pressure contact with said polishing pad.

6. The combination of claim 5 wherein the air bladder is deflatable allowing removal of the disk and reversal of the orientation of the disk such that by reinflation of the air bladder the disk is reclamped and the other of the planar sides of the disk is in a position to be brought into polishing pressure contact with the same polishing pad.

7. The combination of claim 5 wherein the disk mount is rotatable to rotate the clamped disk during polishing and wherein the polishing pad is rotatable in the same circumferential direction as the clamped disk.

8. The combination of claim 5 further including a fixed base and wherein said mount and said retaining ring are gimbal mounted on the fixed base.

9. The combination of claim 8 wherein said fixed base includes a substantially semi-spherical bulbous distal portion and said retainer mount includes a semi-spherical-bottomed bore mounting said bulbous distal portion, providing the gimbal mounting.

10. The combination of claim 9 further including a dampener extending between a periphery of said fixed base and a periphery of an air bladder support ring extending around the retainer mount.

11. The disk processing chuck of claim 2 wherein the retainer mount includes a fixed base having a disk surface cavity exposed on an exposed surface between said central disk support and said retaining ring, a peripheral surface of the fixed base seating the retaining ring; and further including an air bladder support ring extending circumferentially around the retainer mount and retaining said air bladder proximate to the retainer ring; and an air bladder air inlet in said fixed base and extending to an interior of the air bladder.

12. The disk processing chuck of claim 1 wherein the distal ends of the fingers have a radiused tip matching the disk outside diameter.

13. The disk processing chuck of claim 1 wherein said central disk support provides an unclamped support for the disk.

14. The disk processing chuck of claim 1 wherein a clamping force of each distal end of the fingers is less than about 1.5 kg.

15. The disk processing chuck of claim 1, in combination with a polishing machine, wherein the retainer mount in an operational mode is facing downward to position a clamped disk over a polishing pad to prevent ingress of foreign particles by gravitational dropping on a disk being polished.

16. The disk processing chuck of claim 1 wherein each of said distal ends are in line contact with the peripheral edge of a clamped disk and said central disk support is in a circular line contact with a beveled edge of the disk central opening.

17. The disk processing chuck of claim 1 wherein the fingers are flexible cantilevered spring fingers extending from a proximal end of the fingers extending from the retainer mount.

18. The disk processing chuck of claim 1, in combination with a polishing machine, wherein the disk retainer mount is rotatable to rotate a clamped disk and is slidable to oscillate the clamped disk with respect to a polishing pad.

* * * * *